US005315208A

United States Patent [19]

van der Bolt et al.

[11] Patent Number: 5,315,208

[45] Date of Patent: May 24, 1994

[54] COLOR DISPLAY TUBE WITH VIBRATION DAMPING IN A SUPPORTING FRAME CONNECTED TO A SHADOW MASK

[75] Inventors: Antonius J. J. M. van der Bolt; Wilhelmus M. M. van der Steen; Martinus C. M. Verhoeven, all of Eindhoven, Netherlands

[73] Assignee: U.S. Philips Corporation, New York, N.Y.

[21] Appl. No.: 310,493

[22] Filed: Feb. 14, 1989

Related U.S. Application Data

[63] Continuation of Ser. No. 125,916, Nov. 27, 1987, abandoned.

[30] Foreign Application Priority Data

Dec. 1, 1986 [NL] Netherlands ..... 8603055

[51] Int. Cl.[5] ..... H01J 29/81

[52] U.S. Cl. ..... 313/407; 313/269

[58] Field of Search ..... 313/402, 404, 407, 269

[56] References Cited

U.S. PATENT DOCUMENTS

| | | | |
|---|---|---|---|
| 2,930,918 | 3/1960 | Coffin, Jr. | 313/269 |
| 3,553,516 | 1/1970 | Kautz | 313/407 |
| 4,308,485 | 12/1981 | Ignazio | 313/407 |
| 4,645,968 | 2/1987 | Ragland, Jr. | 313/407 |
| 4,714,863 | 12/1987 | Yokoyama et al. | 313/422 X |
| 4,723,088 | 2/1988 | Sone et al. | 313/404 |

*Primary Examiner*—Michael Horabik
*Attorney, Agent, or Firm*—John C. Fox

[57] ABSTRACT

In a color display tube a shadow mask skirt is welded to a frame at least near the ends of two oppositely located sides of the frame, and engages the ends of the other two sides of the frame in a fractional manner.

2 Claims, 2 Drawing Sheets

COLOR DISPLAY TUBE WITH VIBRATION DAMPING IN A SUPPORTING FRAME CONNECTED TO A SHADOW MASK

This is a continuation of application Ser. No. 125,916, filed Nov. 27, 1987, now abandoned.

BACKGROUND OF THE INVENTION

The invention relates to a colour display tube comprising a substantially rectangular display window having an upright edge, a substantially rectangular shadow mask comprising a large number of apertures and a skirt, a substantially rectangular supporting frame to which the skirt of the shadow mask is connected, and suspension means for suspending the supporting frame in the corners of the upright edge.

A colour display tube comprising a shadow mask connected to a supporting frame is disclosed in U.S. Pat. No. 3,368,098. The shadow mask described in said specification is connected to the supporting frame by means of twelve welds. Each side of the shadow mask is connected to the supporting frame by means of three welds, one weld being situated substantially in the centre of the side and the other two welds being situated near the corner of the side at a distance from the centre which is two thirds of the distance between the centre and the corner of the side. Furthermore the supporting frame is suspended in the upright edge of the display window by means of suspension means. Via said suspension means vibrations of the display window can be transmitted to the supporting frame. However, the operation of the colour display tube is adversely influenced by said vibrations of the shadow mask. It has been found in practice that the operation in particular of a colour display tube of which the supporting frame is connected in the corners of the upright edge of the display window is adversely influenced.

It is the object of the invention to provide a colour display tube having an improved operation by damping the detrimental vibrations of the shadow mask.

SUMMARY OF THE INVENTION

For that purpose, according to the invention, a colour display tube of the type described in the opening paragraph is characterized in that the skirt, at least near the ends of two oppositely located sides of the supporting frame, is welded to said supporting frame and adjacent the ends on the other two sides of the supporting frame engages said supporting frame in a frictional manner. As a result of said connection of the shadow mask to the supporting frame the corners of the supporting frame are loaded asymmetrically. As a result of this the least loaded side of the corner, i.e. that side where the skirt engages the supporting frame in a frictional manner, makes a deviating movement with respect to the shadow mask in the case of vibrations of the supporting frame. This movement causes a friction between the skirt of the shadow mask and the supporting frame, as a result of which the vibrations of the supporting frame are damped. As a result of this, only damped vibrations are transmitted to the shadow mask, which damped vibrations influence the operation of the colour display tube less adversely than undamped vibrations.

A preferred form of a colour display tube in accordance with the invention is characterized in that at the ends of the other two sides of the supporting frame the skirt engages the said supporting frame in a clamping manner by means of a resilient element. Said resilient element ensures a defined pressure of the skirt against the supporting frame so that the vibrations can be damped in a defined manner.

A further preferred form of a colour display tube in accordance with the invention is characterized in that the pressure between the skirt and the supporting frame as a result of the frictional engagement has a value between 0.02N and 1.20N. It has been found in practice that a frictional engagement of 0.02N to 1.20N produces a sufficient damping of the vibrations.

BRIEF DESCRIPTION OF THE DRAWINGS

A few preferred forms of the invention will now be described in greater detail, by way of example, with reference to the drawings, in which.

DESCRIPTION OF THE PREFERRED EMBODIMENTS

Figure 1:
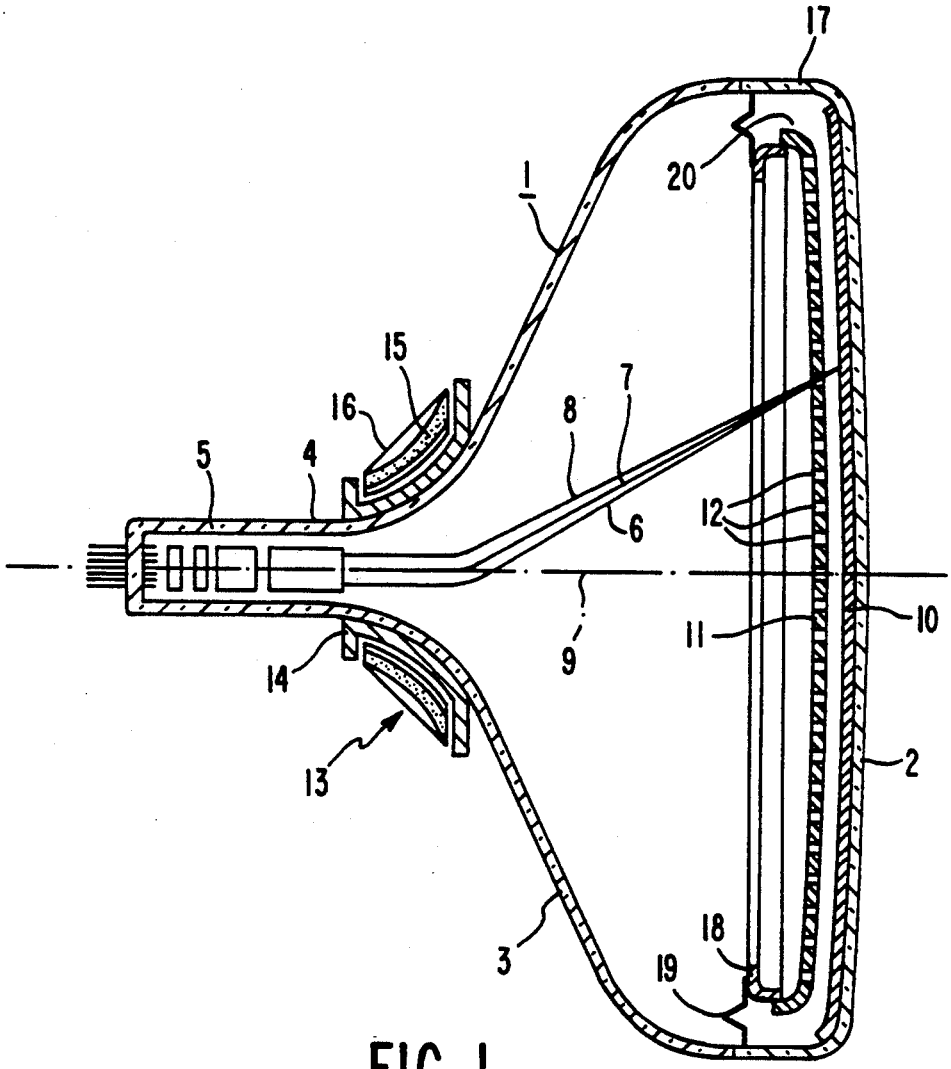
FIG. 1 is a diagrammatic longitudinal sectional view through a colour display tube according to the invention.

FIG. 1 is a diagrammatic longitudinal sectional view through a conventional colour display tube. In this case it is a colour display tube of the "in-line" type, having a glass envelope 1 which is composed of a substantially rectangular display window 2, a cone 3 and a neck 4. In said neck 4 an integrated electron gun system 5 is provided which generates three electron beams which before deflection are situated with their axes in one plane. The axis of the central electron beam 7 coincides with the tube axis 9. The display window 2 has an upright edge 17 and comprises on its inside a large number of triplets of phosphor elements. The elements may be lines or dots. Each triplet comprises an element consisting of a green-luminescing phosphor, an element consisting of a red-luminescing phosphor, and an element consisting of a blue-luminescing phosphor. All triplets together constitute the display screen 10. In front of the display screen 10 a substantially rectangular shadow mask 11 is positioned which includes a skirt 20 and in which a very large number of apertures 12 are provided through which the electron beams 6, 7 and 8 pass which each impinge only on phosphor elements of one colour. The skirt 20 of the shadow mask 11 is connected to a supporting frame 18 which is suspended in the corners of the upright edge 17 of the display window 2 via suspension means 19 which are shown diagrammatically. The three electron beams situated in one plane are deflected by a system of deflection coils 13 which comprises a line deflection coil 14, a yoke ring 15 and a field deflection coil 16.

Figure 2:
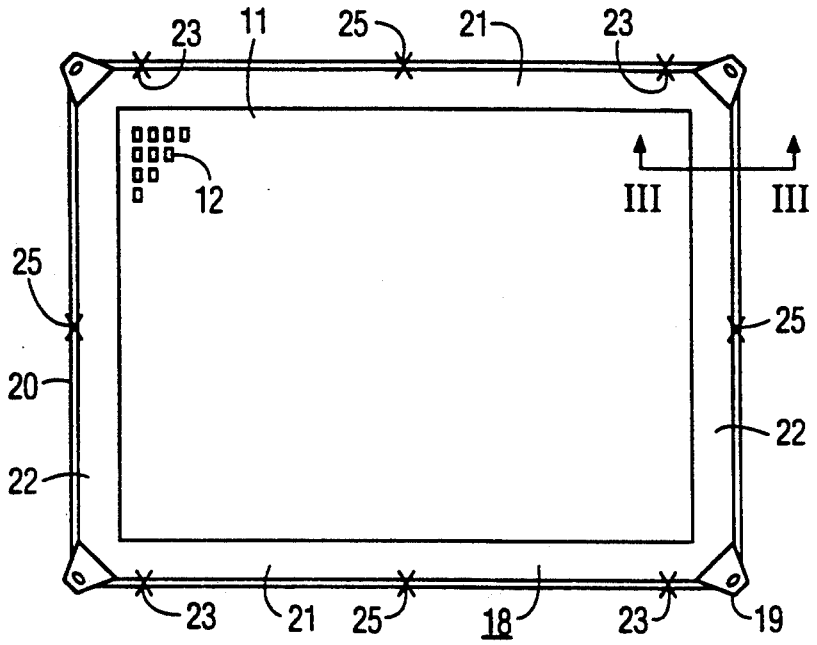
FIG. 2 is an elevation of a connection between a shadow mask and a supporting frame present in the colour display tube according to the invention.
Figure 3:
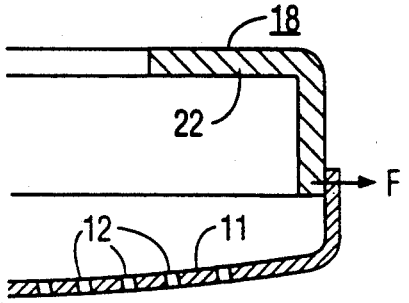
FIG. 3 is a sectional view taken on the line III—III of FIG. 2.

Vibrations which are formed, for example, outside the envelope by impact, shock or sound and which are transmitted to the supporting frame 18 via the suspension means 19 in the corners are damped in the colour display tube according to the invention by a connection of the shadow mask 11 to the supporting frame as will be described with reference to FIG. 2. FIG. 2 is an elevation of a connection between a shadow mask 11 present in the colour display tube and a supporting frame 18 viewed in the direction from the neck of the colour display tube. The skirt 20 of the shadow mask 11 is connected at the corner regions of the supporting frame 18 by means of welds 23 which are present near the ends of two oppositely located sides 21 of the supporting frame 18 and at the ends of the other two sides engages the supporting frame 18 in a frictional manner. As a result of said frictional engagement of the skirt 20 to the supporting frame 18 a frictional force is obtained which, as is shown in FIG. 3 by means of the arrow, is substantially perpendicular to the side of the supporting frame 18 where the skirt 20 engages in a frictional manner. As a result of said connection of the shadow mask 11 in the corners of the supporting frame 18, the corners of the supporting frame 18 are loaded asymmetrically. In the corners of the supporting frame 18 the welds 23 transmit vibrations from the supporting frame 18 to the shadow mask 11 rigidly connected to the supporting frame 18 and on the least loaded side of the corner, i.e. that side where the skirt 20 engages the supporting frame 18 in a frictional manner, the supporting frame 18, during vibrations, performs a deviating movement with respect to the skirt 20 of the shadow mask 11. As a result of said deviating movement and the frictional engagement the skirt 20 and the supporting frame 18 rub over each other so that a friction is formed which damps the vibrations. In order to obtain a rigid connection between the shadow mask 11 and supporting frame 18 the skirt 20 is moreover connected by means of welds 25 which are present, for example, substantially in the centre of the sides 21, 22. As a result of the asymmetrical load of the corner of the supporting frame the vibrations are damped very effectively. Said damping of the vibrations in the corners is of importance since the vibrations are transmitted to the supporting frame mostly in the corners of the envelope.

The value of the frictional force F (FIG. 3) which is necessary to obtain a good vibration damping depends on many different properties. Inter alia, the size and the mass of the shadow mask and the supporting frame and the material from which they are manufactured play a role in damping the vibrations. It has been found in practice that vibrations in the range of the natural resonance of the shadow mask and the supporting frame are readily damped at a frictional force of 0.02N to 1.20N.

Figure 4:
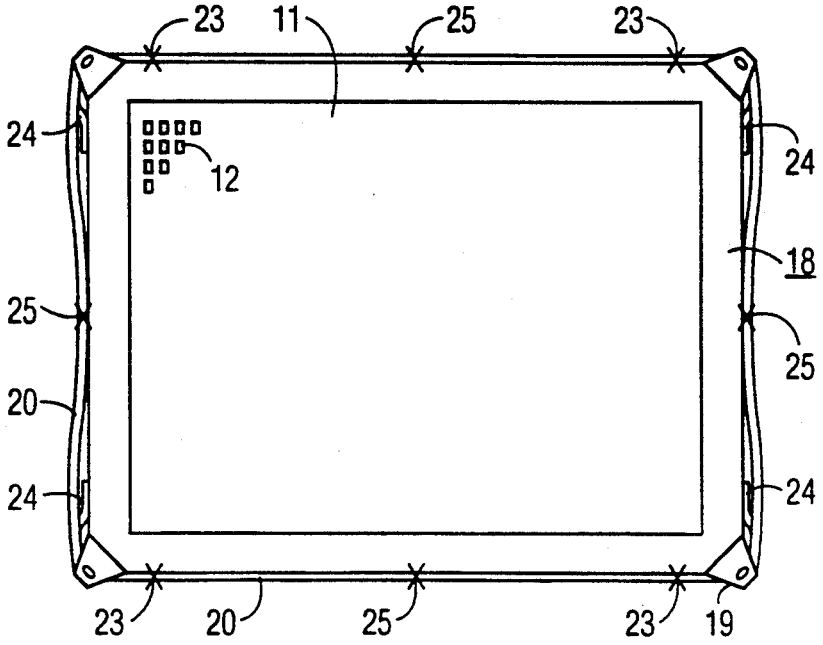
FIG. 4 is an elevation of another embodiment of a connection between a shadow mask and a supporting frame present in the colour display tube according to the invention.

The frictional engagement between the skirt and the supporting frame may be realised, for example, by choosing the inside dimension of the skirt of the shadow mask and the external dimensions of the supporting frame in such a manner that after welding the desired frictional engagement is obtained. However, the FIG. 4 embodiment shows an alternative form of connection between a shadow mask present in the colour display tube according to the invention and a supporting frame with which the desired frictional engagement can be obtained. The skirt 20 of the shadow mask 11 now engages the supporting frame 18 by means of a resilient element 24, which resilient element 24 is constructed so that the desired frictional engagement is obtained. The resilient element 24 may be formed, for example by a saw cut of the skirt 20 of the shadow mask 11 but it may also be a separate element. As a result of said resilient element a readily defined frictional engagement is obtained and moreover the dimensions of the shadow mask and the supporting frame need not be so accurately matched to each other.

As a result of said good damping of undesired vibrations, the colour display tube according to the invention has an improved landing of the electron beams on their associated phosphor elements and consequently an improved operation.

What is claimed is:

1. A color display tube comprising an envelope having a substantially rectangular display window comprising an upright edge extending around the periphery of the display window, a substantially rectangular shadow mask comprising a large number of apertures and a skirt, a substantially rectangular supporting frame to which the skirt of the shadow mask is connected, and suspension means for suspending the supporting frame in the corners of the upright edge, characterized in that, at least near the ends of two oppositely located sides of the supporting frame, the skirt is welded to said supporting frame, and near the ends of the other two adjacent sides of the supporting frame the skirt engages said supporting frame in a weld-free frictional manner by means of a resilient element, this arrangement causing an assymmetrical load at the corners of the supporting frame, resulting in very effective damping of vibrations.

2. A colour display tube as claimed in claim 1, characterized in that the pressure between the skirt and the supporting frame as a result of the frictional engagement has a value between 0.02N and 1.20N.

* * * * *